US008035017B1

(12) United States Patent
Morris

(10) Patent No.: US 8,035,017 B1
(45) Date of Patent: Oct. 11, 2011

(54) METHOD OF MANUFACTURING PICK FOR STRINGED INSTRUMENT

(76) Inventor: B. Scott Morris, New Castle, DE (US)

( * ) Notice: Subject to any disclaimer, the term of this patent is extended or adjusted under 35 U.S.C. 154(b) by 22 days.

(21) Appl. No.: 12/763,498

(22) Filed: Apr. 20, 2010

(51) Int. Cl.
*G10D 7/00* (2006.01)

(52) U.S. Cl. ..... 84/320

(58) Field of Classification Search ..... 84/315–317, 84/320–322
See application file for complete search history.

(56) References Cited

U.S. PATENT DOCUMENTS 6,933,430 B2 * 8/2005 Oskorep ..... 84/322

* cited by examiner

*Primary Examiner* — Kimberly Lockett
(74) *Attorney, Agent, or Firm* — Connolly Bove Lodge & Hutz

(57) ABSTRACT

A pick for a string instrument is manufactured by the use of a hot stamp press. A pick blank is mounted on a support surface of the press with a front side of the pick blank disposed upwardly. A heated die head is moved against the front side of the pick blank and maintained in that position a sufficient time to imprint a pattern configuration into the front side to thereby form a gripping surface on the front side. A film may be disposed between the front side and the die head. A pattern may also be imprinted into the rear side.

15 Claims, 7 Drawing Sheets

METHOD OF MANUFACTURING PICK FOR STRINGED INSTRUMENT

BACKGROUND OF INVENTION

Various string instruments such as guitars, mandolins, banjos, harpsichords, etc. are played with the aid of a pick. Generally, such picks are flat disks of triangular shape where the corners of the triangle are rounded and the perimeter of the pick itself is a single smooth curve. The pick would be held at the wide portion of the triangle and the narrow portion would make contact with the strings of the instrument.

It is known to provide such picks with a gripping surface to enhance the handling of the picks. Conventionally, various methods are used such as machining or laser cutting or manual operations to form the gripping surface on the pick. It would be desirable if a reliable, yet less expensive method of manufacturing could be used for forming such gripping surfaces.

SUMMARY OF INVENTION

An object of this invention is to provide a method of manufacturing a gripping surface on a pick for a string instrument wherein the method is both reliable and economical.

A further object of this invention is to provide such a method which can make use of known equipment to provide such gripping surface.

A still further object of this invention is to provide such a method wherein a gripping surface could be formed on both the front and rear sides of the pick.

In accordance with this invention the gripping surface is imprinted into a pick blank or substrate by use of a hot stamp press.

THE DRAWINGS

DETAILED DESCRIPTION

FIGS. 1-7 illustrate a pick 10 which could be used for playing various string instruments, such as a guitar, mandolin, banjo, harpsichord, etc. The pick 10 has a generally flat front side 12 and a generally flat rear side 14. Pick 10 is also of generally triangular shape formed by a smooth continuous curve about its periphery wherein the corners of the triangle would be rounded. Pick 10 could be about 1¼ inches in its maximum length from the top edge to the bottom edge and about 1 inch in maximum width from one rounded corner to the other at the top. Except for the later described gripping structure each side of pick 10 could be completely flat and planar or could taper slightly inwardly at its periphery.

Figure 1:
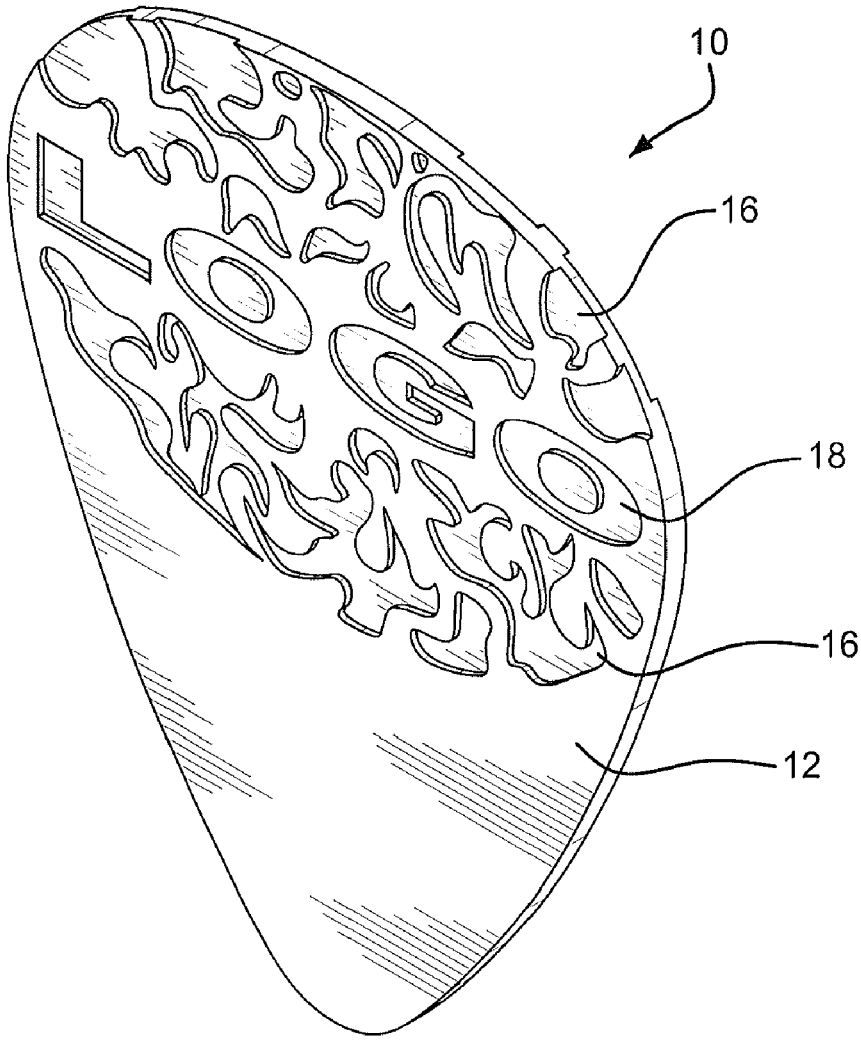
FIG. 1 is a perspective view illustrating a pick for a string instrument made in accordance with this invention.
Figure 2:
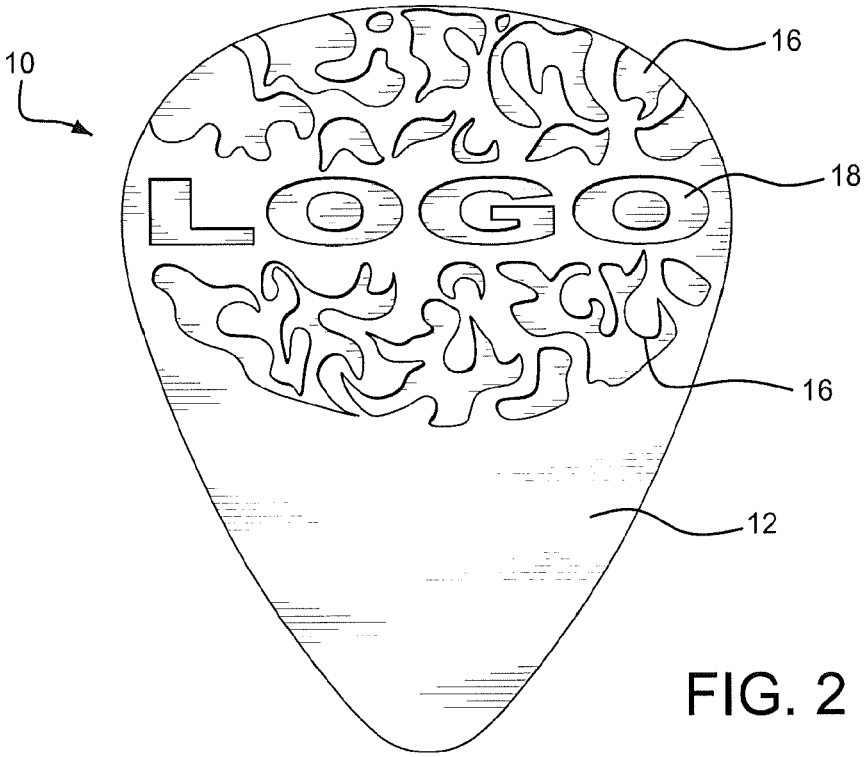
FIGS. 2-3 are front and rear elevational views of the pick shown in FIG. 1.
Figure 4:
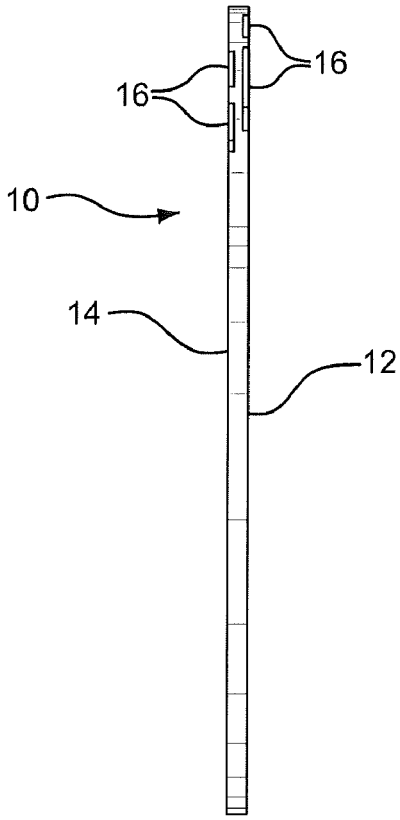
FIGS. 4-5 are end elevational views of the pick shown in FIGS. 1-3.
Figure 5:
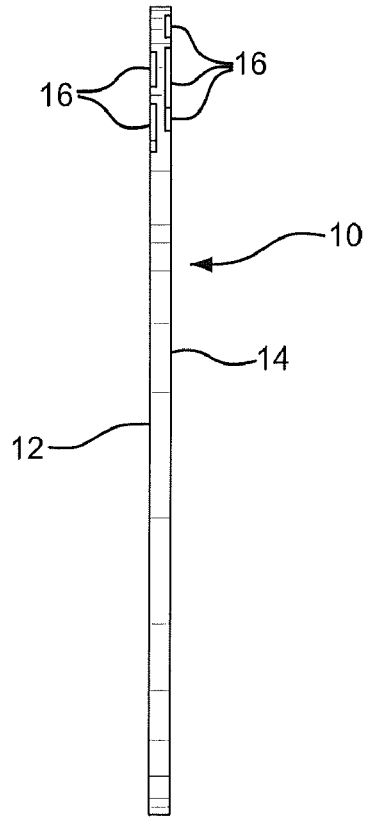
Figure 6:
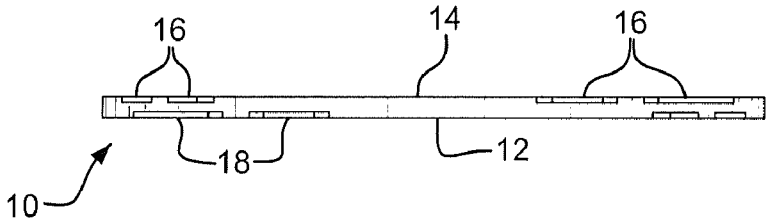
FIGS. 6-7 are top and bottom plan views of the pick shown in FIGS. 1-5.
Figure 7:
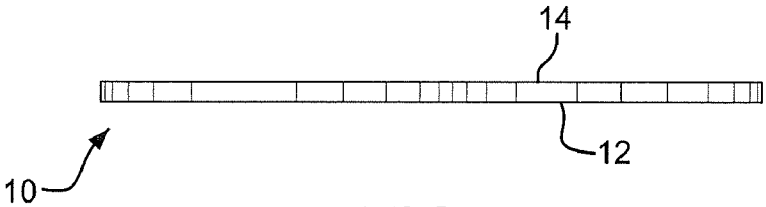
Figure 8:
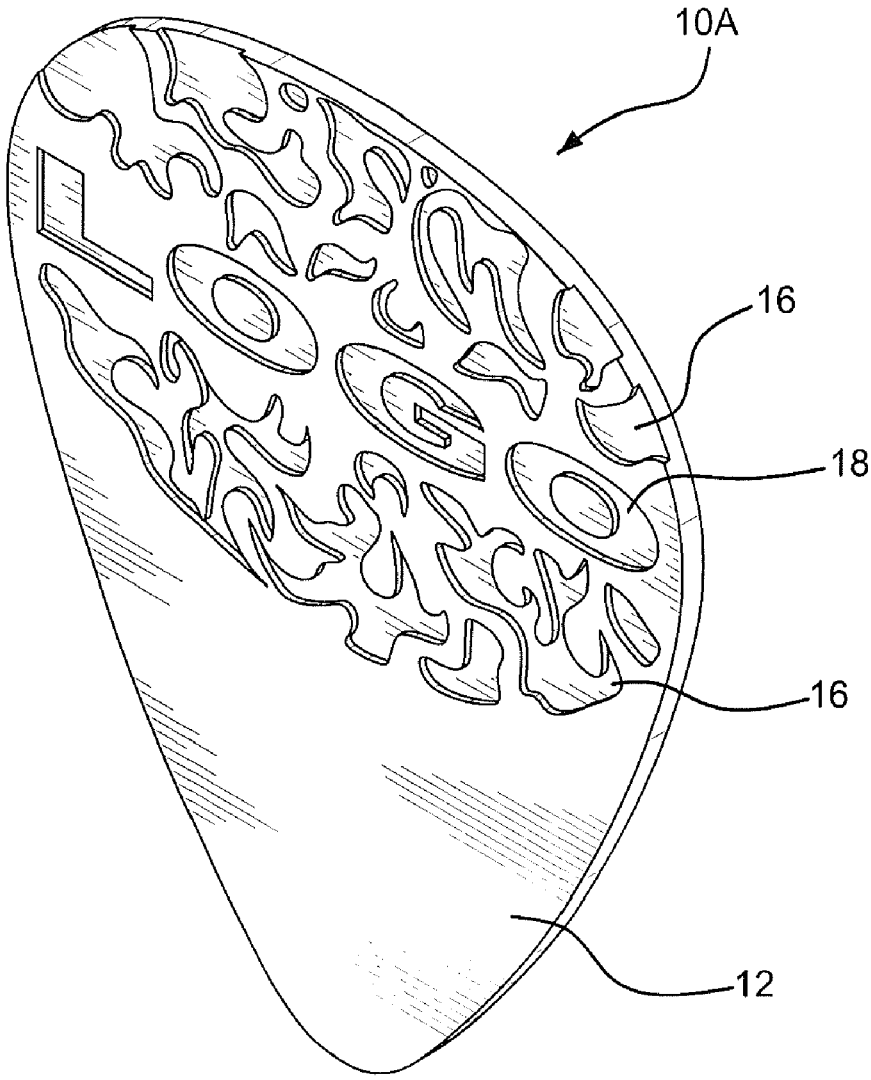
FIG. 8 is a perspective view of a modified form of pick formed by the method of this invention.
Figure 9:
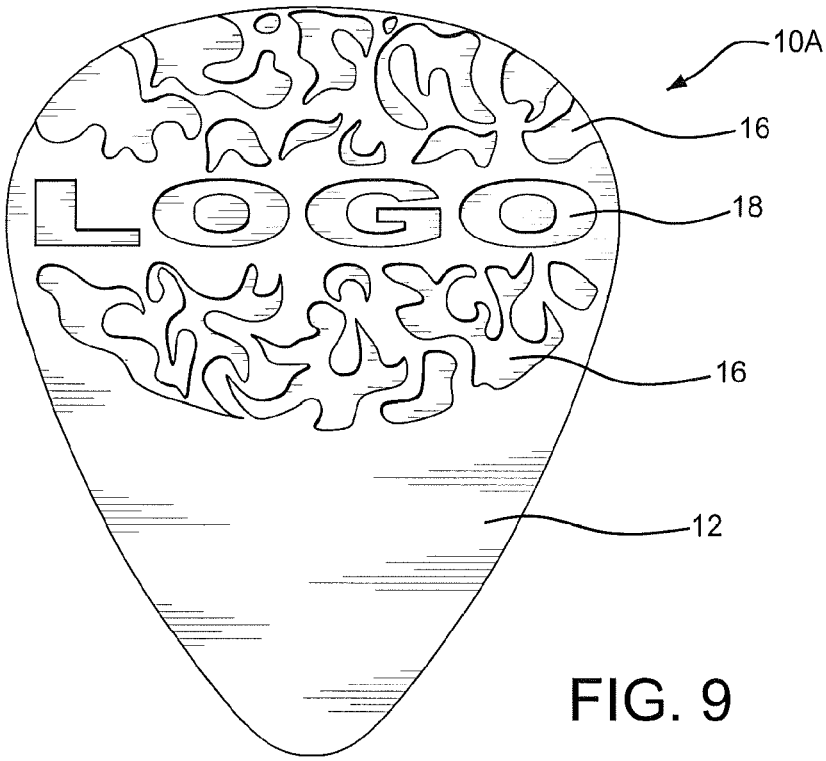
FIGS. 9-10 are front and rear elevational views of the pick shown in FIG. 8.
Figure 10:
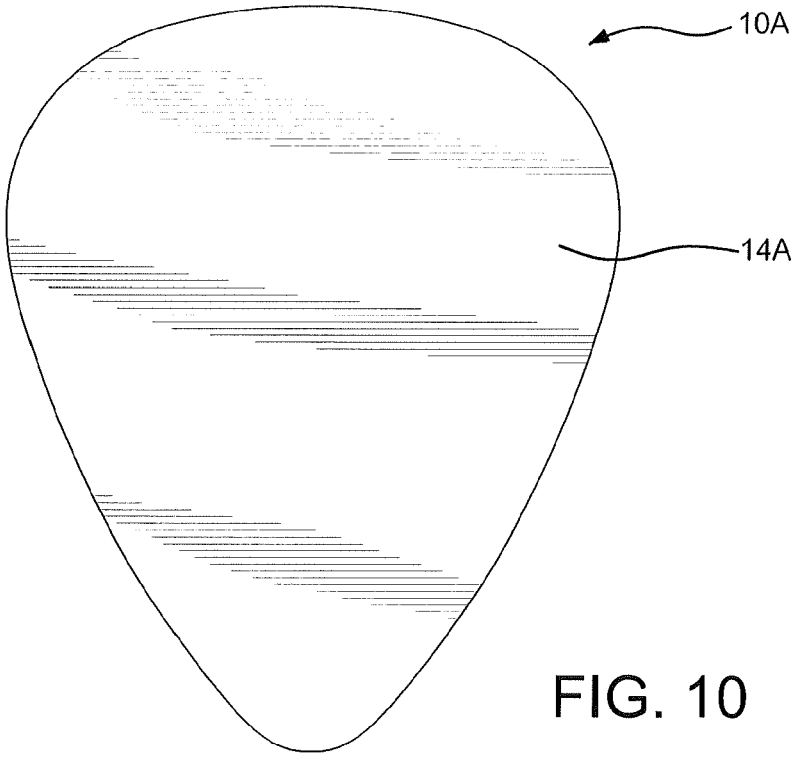
Figure 11:
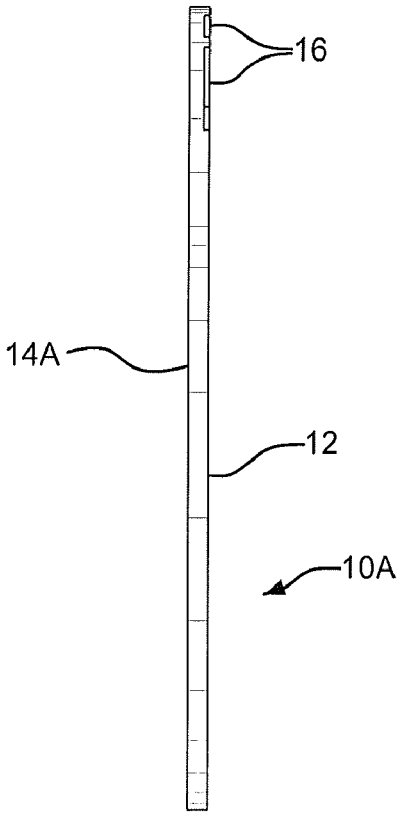
FIGS. 11-12 are end elevational views of the pick shown in FIGS. 8-10.
Figure 12:
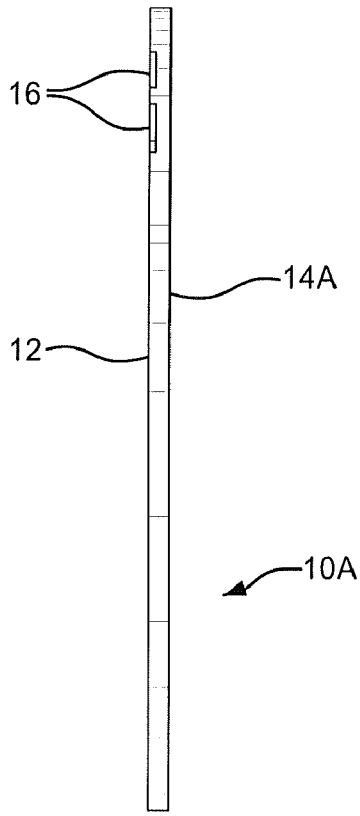
Figure 13:
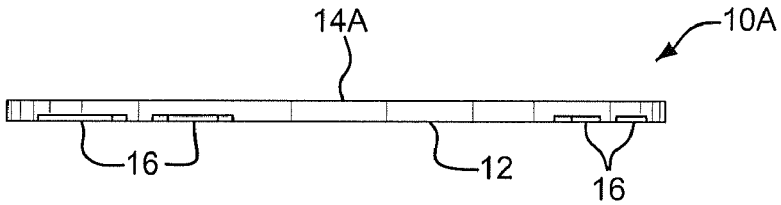
FIGS. 13-14 are top and bottom plan views of the pick shown in FIGS. 8-12.
Figure 14:
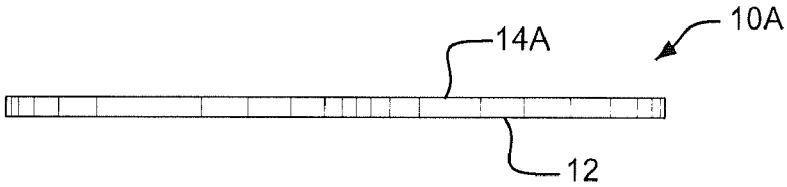

As shown in FIGS. 1-2 the front side 12 of the pick 10 includes a recessed pattern 16 which is generally confined to the upper half of the pick at its wide portion. The pattern 16 provides a gripping surface to facilitate the user gripping the pick 10. If desired, pattern 16 may be formed by two spaced portions with a logo 18 located between the spaced portions for advertisement or other identification purposes. As shown in FIGS. 4-6 the pattern 16 is depressed into and below the flat surface of front side 12.

Figure 3:
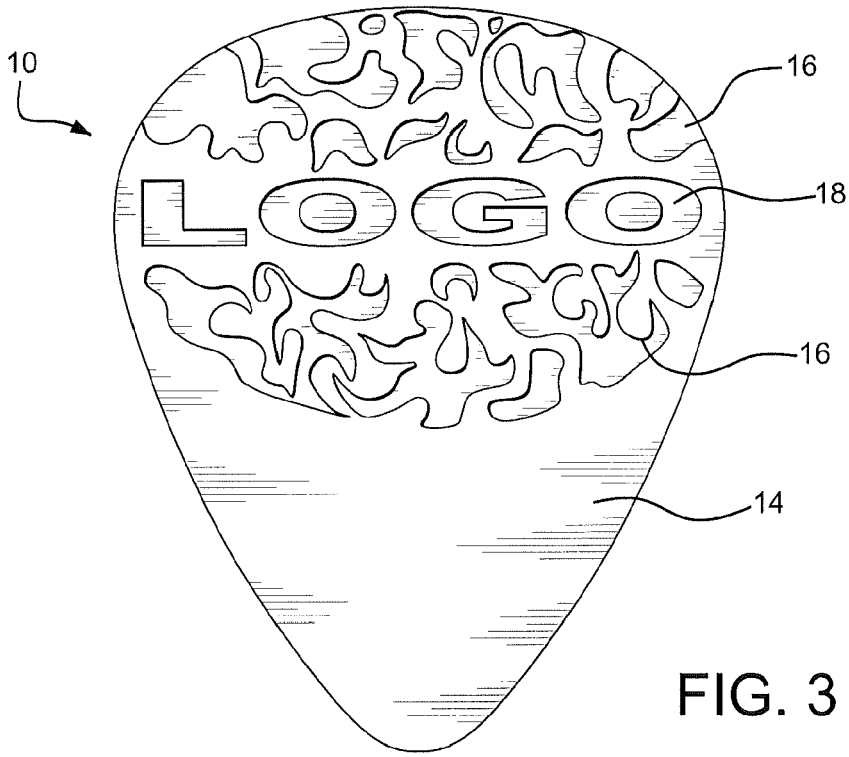

Pick 10 also includes on its rear side a similar pattern 16,16 and logo 18 depressed into and below the flat surface of rear side 14. Although FIGS. 1-3 illustrate the gripping surface to be identical on both the front side and the rear side it is to be understood that the invention could be practiced where the patterns differ from each other and where, for example, a different form of logo or other information might be on each side. Alternatively, the logo can be omitted and the entire upper half of each side could contain simply a textured pattern configuration to provide the gripping surface. In yet another practice of the invention the entire gripping surface could be formed by some form of logo or identification indicia.

FIGS. 8-14 illustrate a pick 10A which is similar to pick 10 except that its rear surface 14A is completely smooth rather than having a gripping surface formed into the rear side.

It is to be understood that the drawings illustrate preferred forms of locating the gripping surface on the pick. The invention, however, may be practiced where the gripping pattern is provided over a greater or lesser area on the front and/or rear sides of the pick including being provided at different locations on the pick such as spaced portions at different areas of either or both sides.

Figure 15:
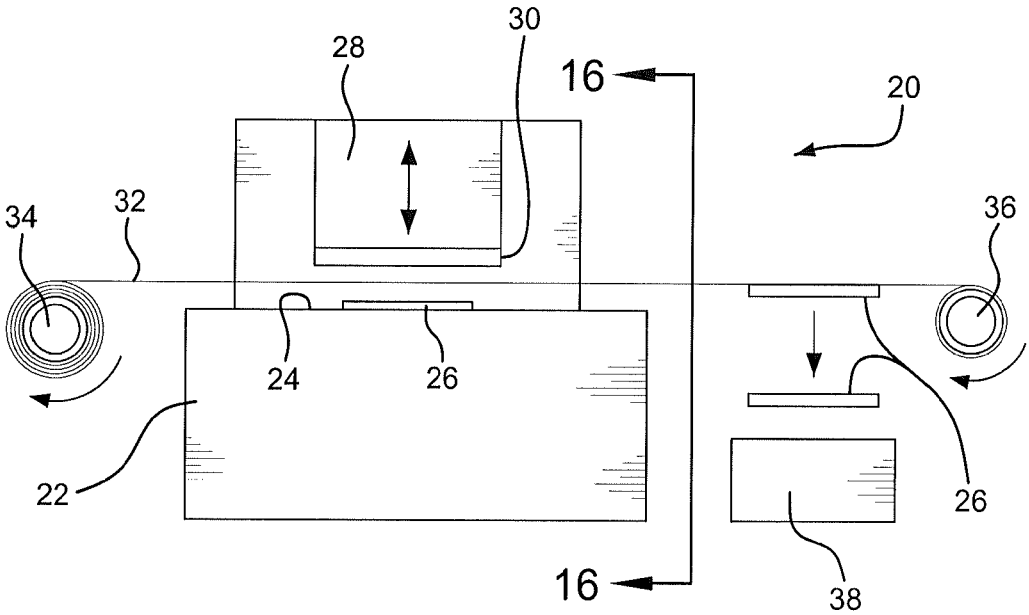
FIG. 15 is a front elevational view schematically showing the use of a hot stamp press for making the picks of FIGS. 1-14.
Figure 16:
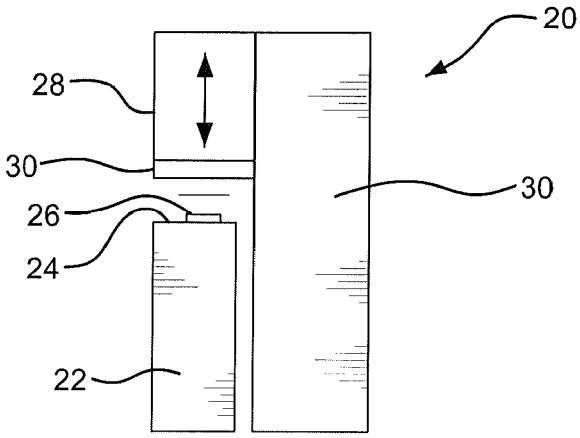
FIG. 16 is a cross-sectional view taken through FIG. 15 along the line 16-16.

FIGS. 15-16 illustrate the preferred manner of manufacturing a pick 10 or 10A in accordance with this invention. As shown therein, the method of manufacture includes the use of a hot stamp press. Such hot stamp press 20 is schematically illustrated as regards the main components for manufacturing the pick. Any suitable hot stamp press may be used such as the Model No. H-150M foiled stamping machine of Printer-maker. Essentially, a suitable hot stamping machine or press 20 would include a support member 22 having an upper pick supporting surface 24 on which a pick blank or substrate 26 would be placed. Directly above the pick blank 26 would be a die 28 having a die head 30 with a pattern configuration corresponding to the pattern 16,18 that would form the gripping surface. Die 28 would be mounted to support column 30 for movement in a vertical direction.

In the preferred practice of this invention the hot stamp press 20 also includes a film 32 that is supplied from supply roll 34 and travels in the space between pick blank 26 and the elevated die head 30. Film 32 extends to take-up roller 36. In practice the foil or film might be located about ½ inch below die head 30 and about 1 inch above pick blank 26. When die 28 is lowered, die head 30 is moved toward contact with the upper surface of pick blank 26 depressing the film 32 against the upper surface of pick blank 26. Die head 30 is heated to a sufficient temperature and remains in pressing contact against the pick blank 26 with the intermediate film 32, for a sufficient time to imprint the pattern into the upper surface of pick blank 26. When the die 28 and its die head 30 are moved upwardly out of contact with the foil or film 32, the pick blank 26 sticks to the lower surface of foil 32. When foil 32 is then moved toward take-up roller 36, the imprinted pick blank 26 is carried with it. The imprinted pick blank 26 then drops into a collection bin or box 38 as shown in FIG. 15. The pick blank 26 thereby forms pick 10A of FIGS. 8-14.

In order to make the pick 10 of FIGS. 1-7 the pick blanks 26 which have the pattern incorporated on their front side would be removed from collection bin 38. Each pick blank 26 would then be placed on support surface 24 with the rear side facing upwardly and with the imprinted side being directly on the support surface 24. The previously described process would then be repeated to create the pattern configuration on the rear side.

It is to be understood that any suitable gripping pattern could be used in accordance with this invention such as various ridges, lines or graphics, etc. which are preferably imprinted below the surface of the print blank. Although the gripping pattern could be raised, a recessed pattern is preferred. As noted, the inclusion of a logo helps with the formation of a gripping surface as well as letting the customer know whose pick is being used.

It is to be understood that any suitable hot stamp press could be used in the practice of this invention. Such press uses a combination of heat, dwell time and foil. The foil could be transparent or could be colored. A magnesium die could be used. The die head 30 would contain the logo, text, artwork, etc. or other details that form the gripping surface. Although a magnesium die is preferred, other metal dies, such as steel could be used. Rubber is not particularly preferred. The foil 32 could be a mylar tape which is transparent and keeps the pick blank 26 from sticking/melting on the die support surface 24 and sticking to the die head 30. Materials other than mylar could also be used.

In a practice of this invention the dwell time that the die head 30 presses against the pick blank 26 could be increased, such as by 1% seconds, from the dwell time ordinarily used with hot stamp presses. In addition, the selection of the proper temperature results in burning the image or pattern configuration that gives the instrument player a grip from the raised or embossed or debossed graphics. Different pick materials would require different dwell times, heat temperatures, etc. which would be known to one of ordinary skill in the art given the guidelines of this invention. The advantages of using a hot stamp press is to provide a less costly, yet precise manner of forming the gripping surface than would be achieved from the use of machining, laser cutting or routing by CMC routers, laser engravers, or manual techniques, etc. By disposing the foil 32 a sufficient distance (such as a half inch) from the die head 30 and (such as one inch) from the pick blank 26, the foil 32 can readily be moved from the supply roller 34 to the take up roller 36 and advanced over the pick head 26. The foil 32 would then pick up the pick head 26 after the imprint has been formed in the pick blank 26 to move the pick blank out of the way for the next impression. The pick blank 26 sticks to the underside of the foil 32 and drops into the collection bin or box 38 before the foil reaches the take up reel 36. This use of a hot stamp press for this invention differs from the ordinary uses of such a machine which are not designed to form a gripping surface on a pick. Rather, such machines are designed simply to imprint parts.

The invention could be practiced with the use of a color foil 32 to make the gripping surface. Such color could be gold or could be a black foil on a white pick or a white foil on a black pick or other combinations of colors. The foil would include a pigment color that readily transfers onto the blank 26 being imprinted. Once the foil is used, however, it can not be reused and the take-up reel would be removed with a new supply reel and take-up reel installed.

The invention could be practiced with known hot stamp presses which are programmed to control the heat, the dwell time and the print stroke in accordance with the particular materials being used. The particular setting would be based on the substrate or pick blank 26. The main object is to achieve a pattern on the pick surface that provides an effective grip/texture.

What is claimed is:

1. A method of manufacturing a pick for a string instrument comprising providing a pick blank having a front side and a rear side, inserting the pick blank with its front side uppermost on to a support surface of a hot stamp press below the die head of the press with the die head having a pattern configuration, heating the die head, pressing the heated die head against the front side of the pick blank for a sufficient time to imprint the pattern configuration on the front side to form a gripping surface on the front side, moving the die head away from the imprinted pick blank, and removing the imprinted pick blank from the hot stamp press whereby the pick blank forms a pick with a gripping surface on its front side.

2. The method of claim 1 including inserting a film between the die head and the front side of the pick blank, and pressing the film against the pick blank when the die head contacts the film in the downward movement of the die head.

3. The method of claim 2 wherein the film is movably mounted on a supply member and received on a take-up member, including adhering the imprinted pick blank to the underside of the film after the die head has been moved upwardly out of contact with the film, and moving the film toward the take-up member to remove the pick blank away from the support surface.

4. The method of claim 3 wherein the film is a colored film, and transferring the color to the pick blank as part of the pattern configuration.

5. The method of claim 3 including depressing the pattern configuration into and downwardly below the surface of the front side.

6. The method of claim 5 including depositing the imprinted pick blank into a collection bin by releasing the pick blank from the underside of the film after the pick blank has been removed from the support surface.

7. The method of claim 6 including forming the pattern configuration on a portion of the front side which generally corresponds to the upper portion of a pick, and forming a logo as part of the pattern configuration.

8. The method of claim 7 including placing a pick blank which has already had a pattern configuration formed on its front side on the support surface and with the rear side of the pick blank uppermost, and repeating the imprinting steps to form a pattern configuration on the rear side of the pick blank.

9. The method of claim 1 including placing a pick blank which has already had a pattern configuration formed on its front side on the support surface and with the rear side of the pick blank uppermost, and repeating the imprinting steps to form a pattern configuration on the rear side of the pick blank.

10. The method of claim 9 including inserting a film between the die head and the rear side of the pick blank, and pressing the film against the pick blank when the die head contacts the film in the downward movement of the die head.

11. The method of claim 10 wherein the film is movably mounted on a supply member and received on a take-up member, including adhering the imprinted pick blank to the underside of the film after the die head has been moved upwardly out of contact with the film, and moving the film toward the take-up member to remove the pick blank away from the support surface.

12. The method of claim 11 including depressing the pattern configuration into and downwardly below the surface of each of the rear side and the front side.

13. The method of claim 11 wherein the film is a colored film, and transferring the color to the rear side as part of the pattern configuration.

14. A pick for a string instrument formed by the method of claim 1.

15. A pick for a string instrument formed by the method of claim 9.

* * * * *